US006074056A

United States Patent [19]

Kubo et al.

[11] Patent Number: 6,074,056

[45] Date of Patent: Jun. 13, 2000

[54] INK-JET PRINTER WHICH SECURELY HOLDS A PRINTING MEDIUM WITHOUT CONTAMINATING A PERIPHERAL SURFACE OF A ROTARY DRUM

[75] Inventors: Mitsuo Kubo, Yokohama; Shinichiro Fujii, Mishima, both of Japan

[73] Assignee: Toshiba Tec Kabushiki Kaisha, Tokyo, Japan

[21] Appl. No.: 09/010,915

[22] Filed: Jan. 22, 1998

[30] Foreign Application Priority Data

Jan. 22, 1997 [JP] Japan ..... 9-009719
Mar. 4, 1997 [JP] Japan ..... 9-048840

[51] Int. Cl.[7] ..... B41J 13/02; B41J 13/10; B41J 2/01

[52] U.S. Cl. ..... 347/104

[58] Field of Search ..... 347/139, 104, 347/215; 101/235, 389.1; 271/3.14; 400/622, 645; 346/138

[56] References Cited

U.S. PATENT DOCUMENTS 4,101,018 7/1978 Sokolowski ..... 400/622 X
4,157,178 6/1979 Ollendick ..... 271/3.14 X
5,376,954 12/1994 Kerr ..... 346/138
5,711,223 1/1998 Taylor ..... 101/389.1

FOREIGN PATENT DOCUMENTS 55-87564 7/1980 Japan ..... 347/104
55-87567 7/1980 Japan ..... 347/104
56-27377 3/1981 Japan .
57-174285 10/1982 Japan .

*Primary Examiner*—Susan S. Y. Lee
*Attorney, Agent, or Firm*—Frishauf, Holtz, Goodman, Langer & Chick, P.C.

[57] ABSTRACT

An ink-jet printer includes a rotary drum having a peripheral surface with a plurality of suction holes arranged therein for rotating at a constant speed, a sheet loader for loading a paper sheet to the peripheral surface of the rotary drum, a sheet holding system for holding the paper sheet on the peripheral surface of the rotary drum by applying negative suction pressure to the paper sheet via the suction holes, and a print head for printing an image by jetting ink onto the paper sheet. The rotary drum has an outer cylindrical member which serves as the peripheral surface, an inner cylindrical member having a diameter smaller than the outer cylindrical member, and a partitioning wall for fixing the inner cylindrical member in the outer cylindrical member at a uniform distance from the outer cylindrical member and for partitioning the space between the inner cylindrical member and the outer cylindrical member into a plurality of air rooms in a drum rotational direction. The sheet holding system includes a plurality of suction air holes which are arranged in the inner cylindrical member to associate with the air rooms, a suction unit for suctioning air via the suction air holes to set the air rooms in a negative pressure state, and an air-flow control mechanism for sequentially setting the suction air holes from a closed state to an open state as the suction holes pass a loading position of the paper sheet by rotation of the rotary drum.

6 Claims, 8 Drawing Sheets

INK-JET PRINTER WHICH SECURELY HOLDS A PRINTING MEDIUM WITHOUT CONTAMINATING A PERIPHERAL SURFACE OF A ROTARY DRUM

BACKGROUND OF THE INVENTION

The present invention relates to an ink-jet printer which performs printing by jetting ink onto a sheet of paper held on a rotary drum as a printing medium.

Recently, personal computers of high performance and low cost have been readily available, and widely spreading rapidly. With this spread, demands for color printers also increase. For personal use, various ink-jet printers have been developed for color printing.

Conventionally, for example, an ink-jet printer capable of printing 500 sheets or more continuously is known. The ink-jet printer includes a hollow rotary drum which rotates at a constant circumferential speed and a print head for jetting color ink to a paper sheet held on the peripheral surface of the rotary drum. The paper sheet is loaded on the rotary drum from the front side thereof and printed in a state wound around the rotary drum. After printing, the paper sheet is removed from the rotary drum to be discharged to the rear side of the rotary drum.

The print head includes, for example, yellow, cyan, magenta, and black nozzle units arranged around the peripheral surface of the rotary drum. Each nozzle unit has a plurality of ink-jet nozzles aligned across the paper sheet in the main scanning direction parallel to the axis of the rotary drum and disperses ink from the ink-jet nozzles with the rotation of the drum. Each nozzle unit is shifted in the main scanning direction at a constant rate for each revolution of the rotary drum, and is returned to a home position after a predetermined number of revolutions which cause the nozzle unit to be moved by a distance equal to the nozzle pitch. Each nozzle unit performs printing of the whole paper sheet by jetting ink in the main scanning direction and the sub-scanning direction perpendicular to the main scanning direction as described above.

It is preferable that the paper sheet is held on the rotary drum in a state where the rotary drum is rotating, and removed from the rotary drum after printing without stopping the rotation of the rotary drum so as to achieve high speed printing. Therefore, a conventional ink-jet printer holds the paper sheet on the rotary drum using negative pressure suction force. In this case, a plurality of suction holes are formed as through holes spread in the entire peripheral surface of the rotary drum. Further, a negative pressure creating section is provided for setting the inside of the rotary drum in a negative pressure state. The paper sheet is held on the peripheral surface of the rotary drum by negative pressure suction force applied thereto through the suction holes. Moreover, the negative pressure suction force is eliminated to remove the paper sheet from the peripheral surface of the rotary drum.

However, in the above-mentioned ink-jet printer, the peripheral surface of the rotary drum may be contaminated when a foreign substance such as ink from an ink nozzle is suctioned by some of the suction holes.

BRIEF SUMMARY OF THE INVENTION

An object of the present invention is to provide an ink-jet printer capable of securely holding a printing medium without contaminating the peripheral surface of a rotary drum.

According to the present invention, there is provided an ink-jet printer which comprises a rotary drum, having a peripheral surface with a plurality of suction holes arranged therein, for rotating at a constant speed; a medium loading section for loading a printing medium to the peripheral surface of the rotary drum; a medium holding system for holding the printing medium on the peripheral surface of the rotary drum by applying negative pressure suction to the printing medium via the suction holes; and a print head for printing an image by jetting ink onto the printing medium held on the peripheral surface of the rotary drum, wherein the rotary drum has an outer cylindrical member serving as the peripheral surface, an inner cylindrical member having a diameter smaller than the outer cylindrical member, and a partitioning wall section for fixing the inner cylindrical member in the outer cylindrical member at a uniform distance from the outer cylindrical member and partitioning the space between the inner cylindrical member and the outer cylindrical member into a plurality of air rooms in a drum rotational direction, the medium holding system includes a plurality of air holes which are arranged in the inner cylindrical member to associate with the air rooms, a suction unit for suctioning air via the air holes to set the air rooms in a negative pressure state, and an air-flow control mechanism for sequentially setting the air holes from a close state to an open state as the suction holes pass a loading position of the printing medium due to rotation of the rotary drum.

According to the ink-jet printer, the air holes are sequentially set from the close state to the open state as the suction holes pass the loading position of the printing medium due to the rotation of the rotary drum. In this case, since the suction unit causes only the air rooms associated with the suction holes covered by the printing medium to be set in the negative pressure state, a foreign substance such as an ink from an ink nozzle may not be inadvertently suctioned via some of the suction holes. Therefore, the printing medium can be held securely without contaminating the peripheral surface of the rotary drum.

DETAILED DESCRIPTION OF THE INVENTION

An ink-jet printer according to one embodiment of the present invention will now be described with reference to FIGS. 1 to 6C.

The ink-jet printer is used for multi-color printing on a paper sheet M cut as a printing medium. The paper sheet M can be, for example, a plain paper or an OHP sheet. As to the sheet size, for example, B5, EXEC, A5, A4, LETTER can be used.

Figure 1:
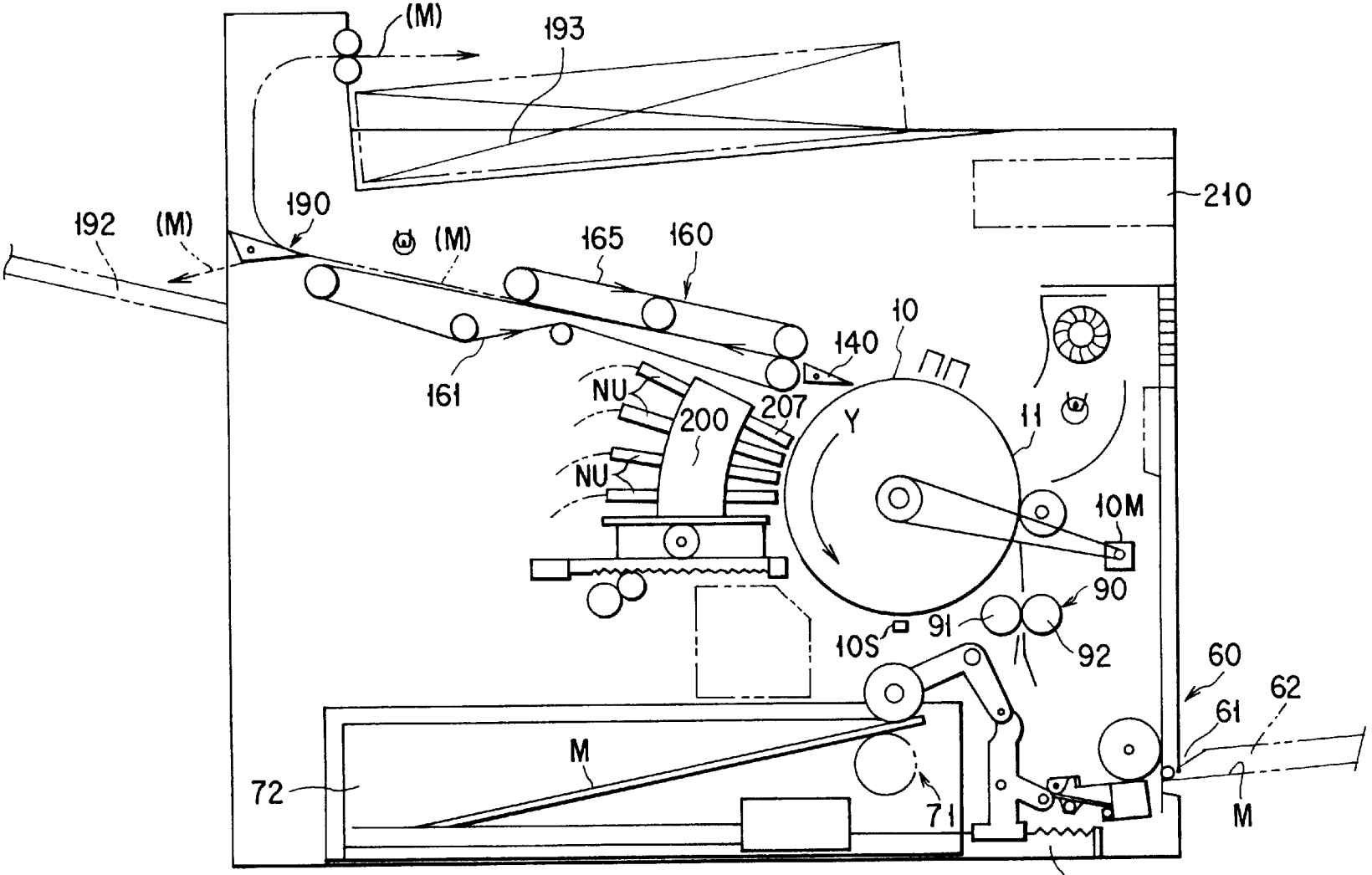
FIG. 1 is a view showing the internal structure of an ink-jet printer of one embodiment of the present invention.

FIG. 1 shows the internal structure of this ink-jet printer. The ink-jet printer comprises a rotary drum 10 for rotating at a constant circumferential speed while holding the paper sheet M, a print head 200 for performing multi-color printing for the paper sheet M rotating together with the rotary drum 10, a manual feed tray 62 for supporting each paper sheet M inserted one by one, a paper cassette 72 for storing a stack of paper sheets M inserted, a sheet feed-in mechanism 60 for feeding each paper sheet M from the paper cassette 72 and the manual feed tray 62 to the rotary drum 10, a sheet feed-out mechanism 160 for feeding out the paper sheet M printed at the rotary drum 10, and a control unit 250 for controlling the whole operation of the ink-jet printer. As shown in FIG. 1, the rotary drum 10 is arranged near the center position in a housing 1. The tray 62 is arranged to project outwardly from the front portion of the housing 1 located at a position lower than the rotary drum 10. The paper cassette 72 is arranged below the rotary drum 10. The sheet feed-in mechanism 60 is arranged between the manual feed tray 62 and the paper cassette 72. The print head 200 is arranged behind the rotary drum 10. The sheet feed-out mechanism 160 is arranged above the print head 200 behind the rotary drum 10.

The rotary drum 10 is rotatably supported around a center axis and has a sheet holding system HL for holding the paper sheet M wound on the peripheral surface 11 with rotation of the rotary drum 10. The rotational position of the rotary drum 10 is detected by a rotational position sensor 10S disposed near the peripheral surface of the rotary drum 10. The print head 200 comprises four nozzle units NU arranged along the peripheral surface 11 of the rotary drum 10 to perform printing for the paper sheet M with cyan, magenta, yellow, and black inks, and receive these color inks from four ink supply sections 210 arranged apart therefrom. Each nozzle unit NU has a plurality of ink-jet nozzles 207 aligned in the axial direction of the rotary drum 10 at a pitch PT, for example, of 1/75 inch to eject a corresponding color ink on the paper sheet M. The ink-jet nozzles 207 are arranged to have a length corresponding to 210 mm, which is the width of the paper sheet M of the A4 size. The sheet feed-in mechanism 60 has a sheet loader 90 for loading the paper sheet M to the rotary drum 10 such that the width direction of the paper sheet M coincides with the axial direction of the rotary drum 10, a manual feeder 61 for picking up the paper sheet M from the manual feed tray 62 and feeding the paper sheet M to the sheet loader 90, a cassette feeder 71 for picking up the paper sheet M from the paper cassette 72 and feeding the paper sheet M to the sheet loader 90, and a feeder switching section 80 for driving one of the manual feeder 61 and the cassette feeder 71. The sheet loader 90 is controlled to load the paper sheet M to the rotary drum 10 when the position sensor 10S detects that the rotary drum 10 has reached a predetermined position by rotation. The paper sheet M is held by the sheet holding system HL on the peripheral surface 11 of the rotary drum 10. The print head 200 performs color printing for the paper sheet M during rotation of the rotary drum 10.

After printing, the paper sheet M is removed from the peripheral surface 11 of the rotary drum 10 by a sheet separator 140 and fed in a preset direction by the sheet feed-out mechanism 160. The sheet separator 140 is a separation claw to be in contact with the rotary drum 10 at the time of removing the paper sheet M. A discharge switch 190 selectively guides the paper sheet M to one of a rear discharge tray 192 for discharging with a printing surface facing upward or an upper discharge tray 193 for discharging the paper sheet M with a printing surface facing downward.

The print head 200 is reciprocally movable in the main scanning direction X parallel to the axial direction of the rotary drum 10, and also movable between a printing position adjacent to the peripheral surface 11 of the rotary drum 10 and a stand-by position away from the printing position.

The rotary drum 10 rotates such that the paper sheet M wound around and held on the peripheral surface 11 thereof is moved in the sub-scanning direction Y perpendicular to the main scanning direction X to face the nozzle units NU. The rotary drum 10 is maintained at a constant revolution number of , e.g., 120 rpm and rotates one revolution every 0.5 second in order to achieve multi-color printing of 20 paper sheets per minute, for example. In the printing operation, the nozzle unit NU is shifted in the main scanning direction X at a constant rate of a ¼ nozzle pitch PT each time the rotary drum 10 rotates one revolution so that it moves in a distance equal to the nozzle pitch PT while the rotary drum 10 rotates four revolutions. In this configuration, printing of the entire surface of the paper sheet M can be completed within two seconds (=0.5 second× 4) required to rotate the rotary drum 10 through four revolutions. Even considering a time required to rotate the rotary drum 10 through revolutions for winding up a paper sheet before printing and for removing the paper sheet after printing, multi-color printing can be performed at a high speed of 3 (=2+1) seconds per A4 size paper sheet M. Therefore, 20 paper sheets can be printed continuously per minute.

The sheet loader 90 comprises at least one pair of loading rollers 91 and 92 extending in the drum axial direction, and is used to load each paper sheet M fed from the feeders 61 and 71 to the rotary drum 10 at a predetermined timing. The supply speed of the paper sheet M is set at a speed corresponding to the circumferential speed of the rotary drum 10.

At least one of the loading rollers 91 and 92 receives a rotating force applied from a main motor 10M constituting a feed force applying section together with a gear train, a clutch, and the like. The main motor 10M drives the loading roller 91 and 92 under the control of the control unit 250, and feeds the paper sheet M to the rotary drum 10 side. The rotary drum 10 is rotated by the driving force of the main motor 10M transmitted to the shaft 15 via timing belts and gears. The main motor 10M is constituted by a servo motor, which has excellent quick-response and constant-speed characteristics. Since the diameter of the rotary drum 10 is set at 130 mm, a circumferential speed of 816 mm/sec=120 $\pi$ d/60 is obtained. The peripheral surface 11 of the rotary drum 10 has a width of about 220 mm in the axial direction, and a length of 408 mm (=$\pi$d) in the rotational direction. Therefore, the rotary drum 10 can satisfactorily hold an A4 size paper sheet M having a length of 297 mm and a width of 210 mm.

In the ink-jet printer, the rotary drum 10 has a double cylindrical structure comprising an outer cylindrical member 10A serving as the peripheral surface 11 where a plurality of suction holes 12 are arranged, an inner cylindrical member 10B having a diameter smaller than that of the outer cylindrical member 10A, and a partition wall 17 for fixing the inner cylindrical member 10B in the outer cylindrical member 10A at a uniform distance from the outer cylindrical member 10A and partitioning the space between the inner cylindrical member 10B and the outer cylindrical member 10A into a plurality of air rooms in the drum rotational direction. The medium holding system includes a plurality of suction air holes 14-1 to 14-4 which are arranged in the inner cylindrical member 10B to associate with the air rooms, a suction unit for suctioning air via the suction air holes 14-1 to 14-4 to set the air rooms in a negative pressure state, and an air-flow control mechanism for sequentially setting the suction air holes 14-1 to 14-4 from a close state to an open state as the suction holes 12 pass a loading position of the paper sheet due to the rotation of the rotary drum 10.

Figure 2:
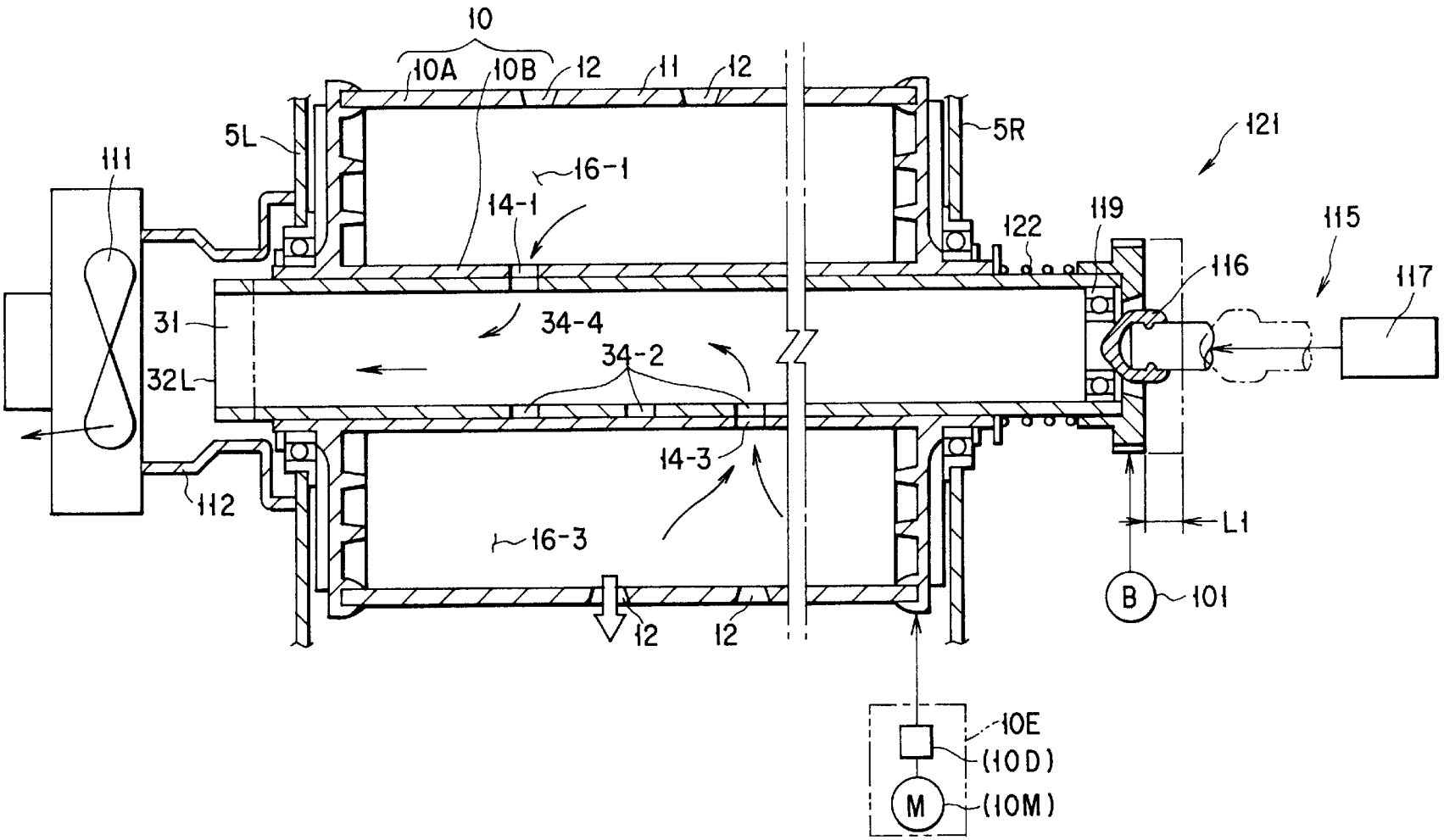
FIG. 2 is a cross-sectional view for explaining a sheet holding system of the ink-jet printer shown in FIG. 1.

Specifically, as shown in FIG. 2, the rotary drum 10 is rotatably supported between brackets 5L, 5R in the printer housing and is driven at a constant circumferential speed in the Y direction by a driving section 10E constituted by the main motor 10M, a driving force transmitting mechanism 10D, and the like. A small diameter hollow tube 31 is inserted in and fitted to the inner cylindrical member 10B such that it can be relatively rotatable. In this embodiment, the small diameter hollow tube 31 is also movable in the axial direction of the rotary drum 10. A gap between the small diameter hollow tube 31 and the inner cylindrical member 10B is tightly sealed with a sealing material (not shown) or the like. A suction fan 111 is provided on the bracket 5L side in order to suction the inner air from the one end 32L of the small diameter hollow tube 31 via the duct 112. On the other hand, a small diameter hollow tube valve 115 is provided on the bracket 5R side in order to open and close the other end 32R of the small diameter hollow tube 31.

Figure 4:
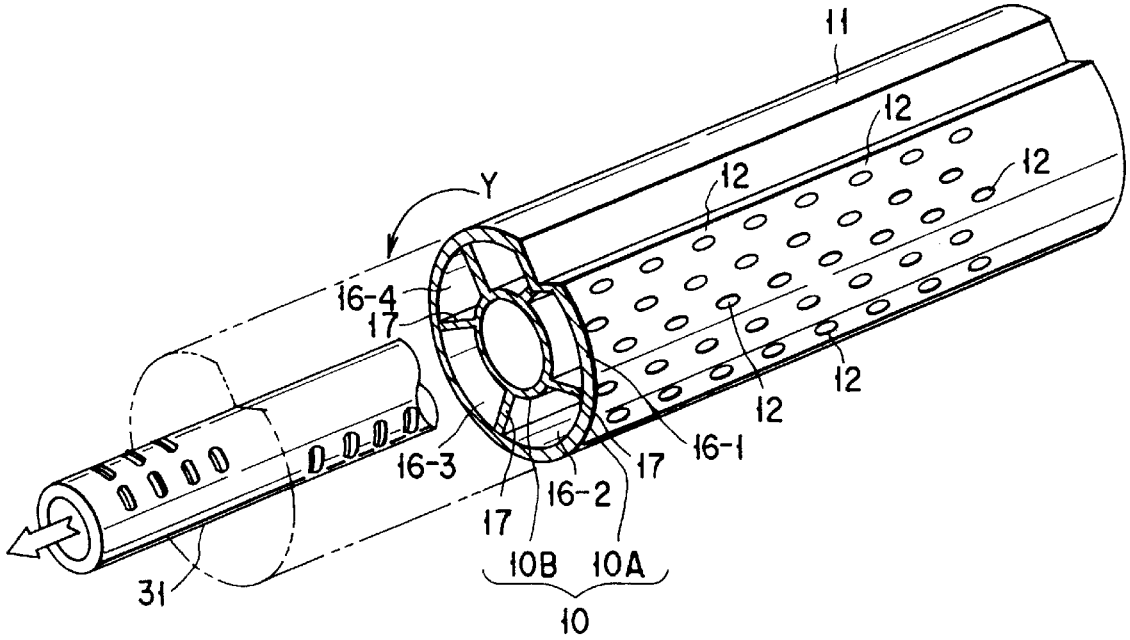
FIG. 4 is a perspective view showing the internal structure of a rotary drum to be adopted to the sheet holding system shown in FIG. 2.

As shown in FIG. 4, the partition wall 17 extends in the radial direction of the rotary drum 10 and partitions the space 16 between the outer cylindrical member 10A and the inner cylindrical member 10B into five air rooms. The four successive air rooms excluding one air room are used as negative pressure creating rooms 16-1, 16-2, 16-3, 16-4. The suction holes 12 are formed in the outer cylindrical member 10A of the rotary drum 10 according to the length of the paper sheet M so that the space of the negative pressure creating rooms 16-1 to 16-4 can communicate with the outside space. The suction holes 12 are formed to have a span set within a range not exceeding the smallest width of the paper sheet M to be used. The plurality of the suction air holes 14-1 to 14-4 are formed in the inner cylindrical member 10B of the rotary drum 10 so that the space of the negative pressure creating rooms 16-1 to 16-4 can communicate with the outside space. The small diameter hollow tube 31 has suction air holes 34-1, 34-2, 34-3, 34-4 formed to face the suction air holes 14-1 to 14-4.

Figure 5:
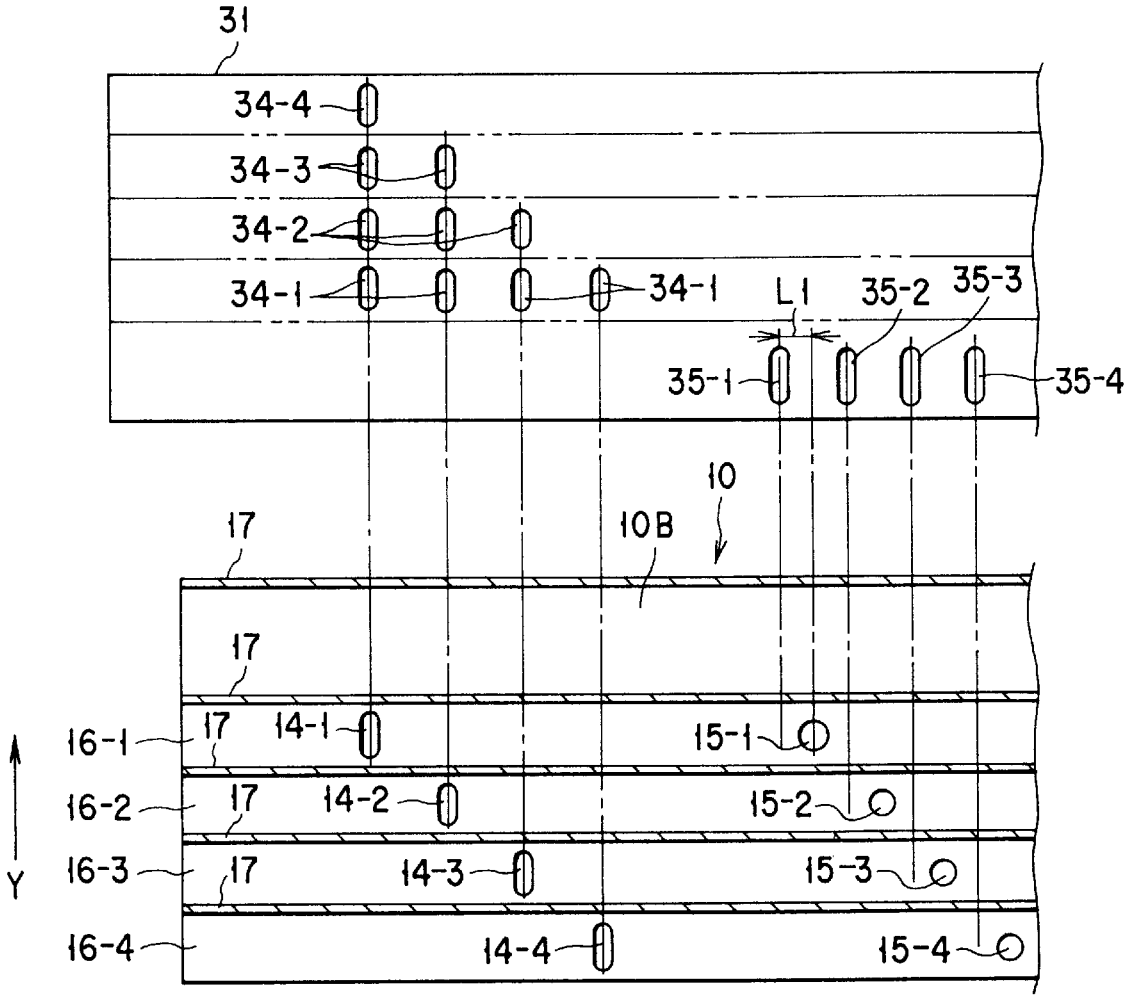
FIG. 5 is a developed view for explaining the positional relationship between air holes of the drum and air holes of a small diameter hollow tube shown in FIG. 4.

As shown in FIG. 5, a plurality of ventilation holes 15-1, 15-2, 15-3, 15-4 are further formed in the inner cylindrical member 10B of the rotary drum 10. In the small diameter hollow tube 31, ventilation holes 35-1, 35-2, 35-3, 35-4 are formed and displaced from the ventilation holes 15-1 to 15-4 in the axial direction of the rotary drum 10 by a predetermined length L1.

The air-flow control mechanism has a stopper 101 as shown in FIG. 2. The stopper 101 opens the suction air holes 14-1 to 14-4 of the rotary drum 10 by sequentially aligning the same with the suction air holes 34-1 to 34-4 from the downstream side to the upstream side in the drum rotational direction (Y direction) using a difference obtained relatively between the rotational speeds of the small diameter hollow tube 31 and the rotary drum 10, and closes the same by releasing the alignment.

The small diameter hollow tube valve 115 is formed to control opening and closing of the other end 32 of the small diameter hollow tube 31, and includes a plug member 116 and an actuator 117 which moves the plug member 116 in the axial direction of the rotary drum 10 to compressingly contact with or separate from the open end (the other end 32R) of the small diameter hollow tube 31. In this embodiment, the small diameter hollow tube valve 115 is used by a small diameter hollow tube moving unit 121 which is formed to move the small diameter hollow tube 31 in the axial direction of the rotary drum 10.

That is, the small diameter hollow tube moving unit 121 includes a urging member (spring 122) for urging the small diameter hollow tube 31 rightward in FIG. 2, the small diameter hollow tube valve 115 (plug member 116, actuator 117), the suction air holes 14-1 to 14-4. The plug member 116 is driven by the actuator 117 to advance the small diameter hollow tube 31 against the urging member (spring 122) and hold at a predetermined position (suction position shown in FIG. 5) where the suction air holes 14-1 to 14-4 are aligned with the suction air holes 34-1 to 34-4. The plug member 116 is displaced back to hold the small diameter hollow tube 31 at a predetermined position (ventilating position) where the ventilation holes 15-1 to 15-4 are aligned with the ventilation holes 35-1 to 35-4. The bearing 119 causes the hollow tube 31 to be rotatable even in a state that the small diameter hollow tube 31 is pressed by the plug member 116.

Figure 6A:
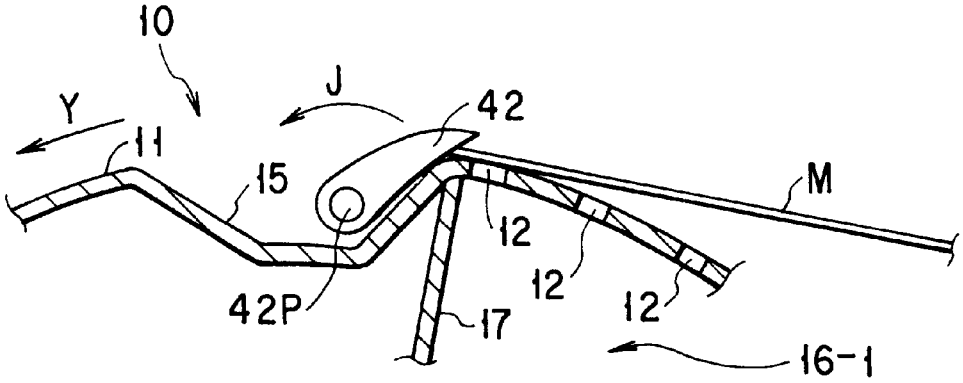
FIGS. 6A to 6C are diagrams for explaining the operation of a sheet positioning unit disposed on the rotary drum shown in FIG. 1.
Figure 6B:
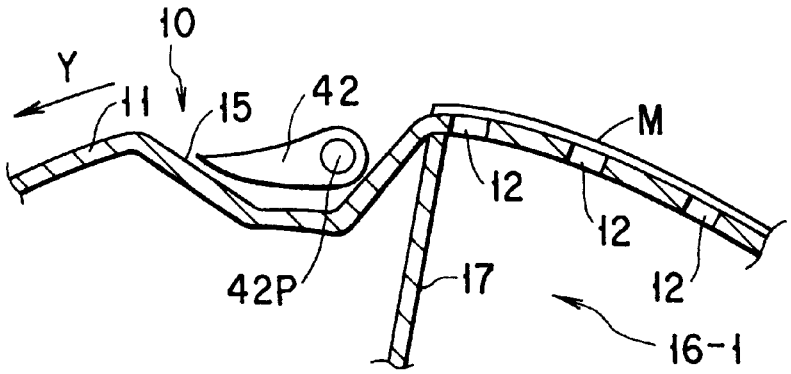
Figure 6C:
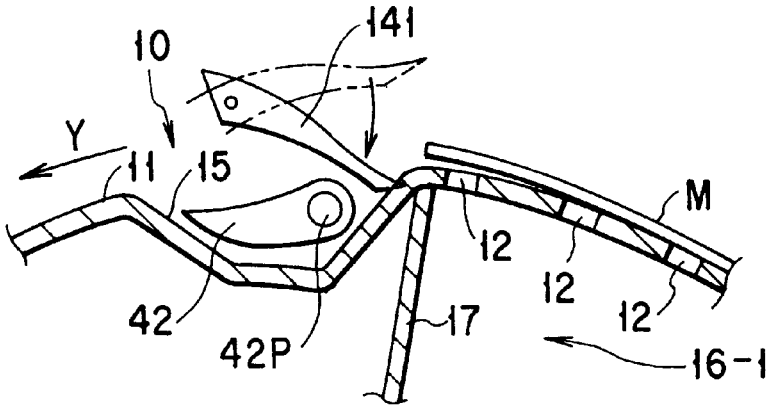

As shown in FIGS. 6A to 6C, the ink-jet printer has a positioning unit for regulating the position of the front end of the paper sheet M on the drum peripheral surface 11. The positioning unit is formed of a positioning member 42 mounted rotatably around a pivot 42P in a dent of the drum peripheral surface 11, and a driver (not shown) for rotating the positioning member 42 in the open direction (J direction) and the close direction (opposite direction with respect to the J direction), for example.

Figure 3:
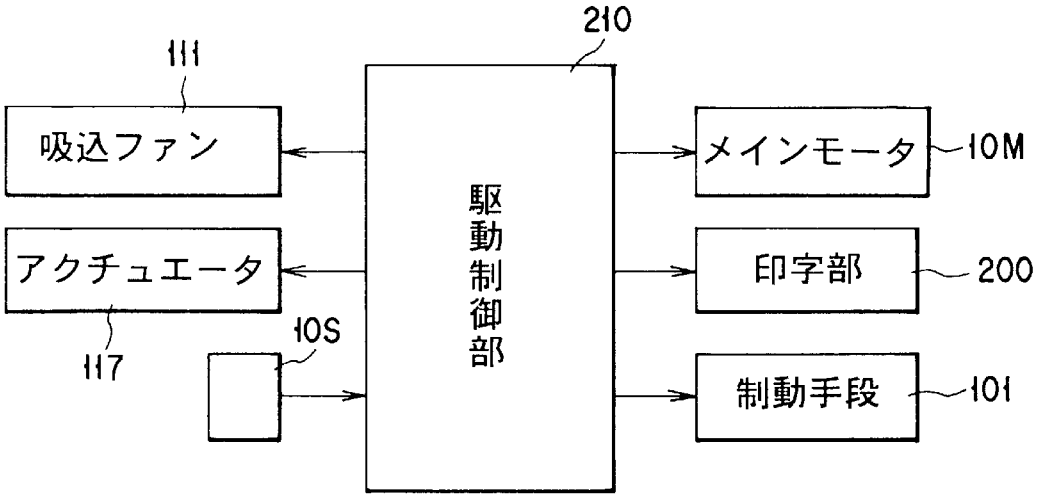
FIG. 3 is a block diagram for explaining a control unit which controls the sheet holding system shown in FIG. 2.

The control unit 210 shown in FIG. 3 includes a CPU, a ROM, a RAM, and the like and is capable of performing the entire drive control of the printer. Components not directly related with this device are not illustrated.

The operation of the ink-jet printer will be described below.

When the control unit 210 enables the stopper 101 in response to the paper sheet M fed to the sheet loading position for the rotary drum 10 in motion, the small diameter hollow tube 31 stops the rotation to sequentially align the suction air holes 14-1 to 14-4 of the rotary drum 10 with the suction air holes 34-1 to 34-4 of the small diameter hollow tube 31 from the downstream side to the upstream side in the rotational direction (Y direction), thereby opening the suction air holes 14-1 to 14-4. That is, the suction air holes 14-1 to 14-4 are sequentially opened in the order opposite to the drum rotational direction.

When the down stream side suction air hole 14-1 is opened, air in the corresponding negative pressure creating room 16-1 is suctioned to the outside through the suction air hole 14-1 to create the negative pressure in the negative pressure creating room 16-1. Therefore, the front end of the paper sheet M reached at a position facing to the suction hole 12 of the negative pressure creating room 16-1 is held by the negative pressure suction applied via the suction hole 12. Since the front end of the paper sheet M is regulated by the positioning member 42, the holding position is accurate.

The rear part of the paper sheet M with respect to the front end is held on the drum peripheral surface 11 by suction using the negative pressure sequentially created in the negative pressure creating rooms 16-2, 16-3, 16-4 of the upstream side in the rotational direction.

In addition, the paper sheet M is selectable from kinds of paper sheets having different length (for example, A4, A5 sheets, and the like). Since the negative pressure creating rooms 16-1 to 16-4 and the suction holes 12 are formed according to the length of the paper sheets M, any selected kind of the paper sheet M can be securely held by suction.

Since the negative pressure is created in each of the negative pressure creating rooms 16-1 to 16-4 in a state where the corresponding suction holes 12 are covered by the paper sheet Ml, a foreign substance (for example, an ink in the print head 200) is not suctioned via the suction hole 12, and thus contamination of the drum peripheral surface 11, and the like can be prevented.

Printing is performed by jetting ink from the print head 200 to the paper sheet M which is held on the drum peripheral surface 11 as described above. At the time, the small diameter hollow tube 31 is rotated at the speed the same as the rotary drum 10 to maintain a state where all the suction air holes 34-1 to 34-4 are aligned with the suction air holes 14-1 to 14-4 respectively. Therefore, printing can be performed on the paper sheet M securely held on the drum peripheral surface 11.

After printing, the actuator 117 is driven to move back the plug member 116 to a position apart from the other end 32R of the small diameter hollow tube 31. Then, the small diameter hollow tube 31 is moved in the axial direction of the rotary drum 10 by a preset length L1 with the other end 32R thereof being opened. At the same time, the rotation of the small diameter hollow tube 31 is stopped. Thereby, the ventilation holes 15-1 to 15-4 of the rotary drum 10 in motion are sequentially aligned with the corresponding ventilation holes 35-1 to 35-4 from the downstream side to the upstream side in the drum rotational direction. Therefore, the negative pressure in each of the negative pressure creating rooms 16-1 to 16-4 is sequentially lost in the order opposite to the drum rotational direction (Y direction). Therefore, the paper sheet M can be released from the drum peripheral surface 11 rapidly and securely.

According to this embodiment, since the negative pressure creating rooms 16-1 to 16-4, the suction hole 12 and the suction air holes 14-1 to 14-4 are provided on the rotary drum 10 side, the stopper 101 and the suction fan 111 are provided on the small diameter hollow tube 31 side, and the suction air holes 14-1 to 14-4 are opened from the downstream side to the upstream side in the rotational direction (Y) of the rotary drum 10 so that the negative pressure is sequentially created in the negative pressure creating rooms 16-1 to 16-4 in the order opposite to the rotational direction (Y), the paper sheet M can be rapidly and securely held on the drum peripheral surface 11 by the negative pressure suction while preventing contamination of the drum peripheral surface 11 with ink.

Further, since the ventilation holes 15-1 to 15-4 are provided on the rotary drum 10 side, the ventilation holes 35-1 to 35-4 associated with the ventilation holes 15-1 to 15-4 are provided on the small hollow tube 31 side, and the small diameter hollow tube valve 115 is provided for opening the other end 32R of the small diameter hollow tube 31, the negative pressure in the negative pressure creating rooms 16-1 to 1-4 can be eliminated by moving the small diameter hollow tube 31 in the axial direction of the rotary drum 10 by a preset length L1 and stopping the rotation thereof such that the ventilation holes 15-1 to 15-4 are sequentially aligned with the corresponding ventilation holes 35-1 to 35-4 from the downstream side to the upstream side in the drum rotational direction. Therefore, the paper sheet M can be released from the drum peripheral surface 11 quickly and securely after printing.

Since positioning of the front end of the paper sheet M held on the drum peripheral surface 11 is performed, the accuracy of the holding position of the paper sheet M can be further improved.

Hereinafter, an ink-jet printer of another embodiment of the present invention will be described with reference to FIGS. 7 to 10.

The ink-jet printer has the same configuration as the aforementioned embodiment excluding the components described below. Therefore, explanation for the same portions is omitted or simplified.

Figure 7:
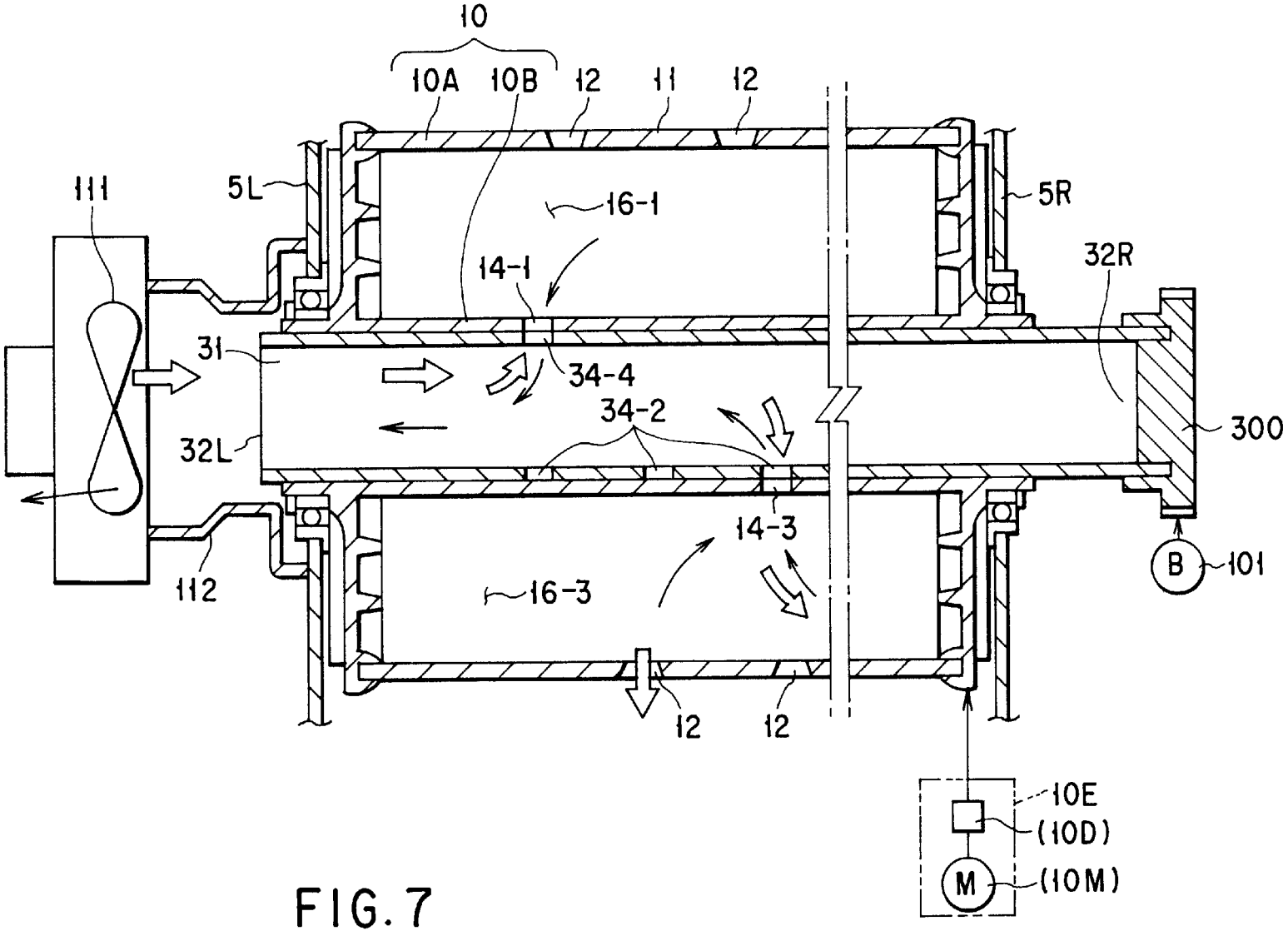
FIG. 7 is a cross-sectional view for explaining a sheet holding system of an ink-jet printer according to another embodiment of the present invention.

In the ink-jet printer, as shown in FIG. 7, the rotary drum 10 has a double cylindrical structure comprising an outer cylindrical member 10A and an inner cylindrical member 10B provided in and concentric with the outer cylindrical member 10A. The rotary drum 10 is rotatably supported between the brackets 5L, 5R in the printer housing (not shown) and is driven at a constant circumferential speed in the Y direction by a driving section 10E constituted by the main motor 10M, a driving force transmitting mechanism 10D, and the like. A small diameter hollow tube 31 is inserted in and fitted to the inner cylindrical member 10B such that it can be relatively rotatable. In addition, a gap between the small diameter hollow tube 31 and the inner cylindrical member 10B is tightly sealed with a sealing material (not shown) or the like. A suction and blow fan 111 is provided on the bracket 5L side in order to suction the inner air from and blowing the air to the one end 32L of the small diameter hollow tube 31 via the duct 112. On the other hand, a sealing member 300 is provided on the bracket 5R side in order to completely seal the other end 32R of the small diameter hollow tube 31.

Figure 9:
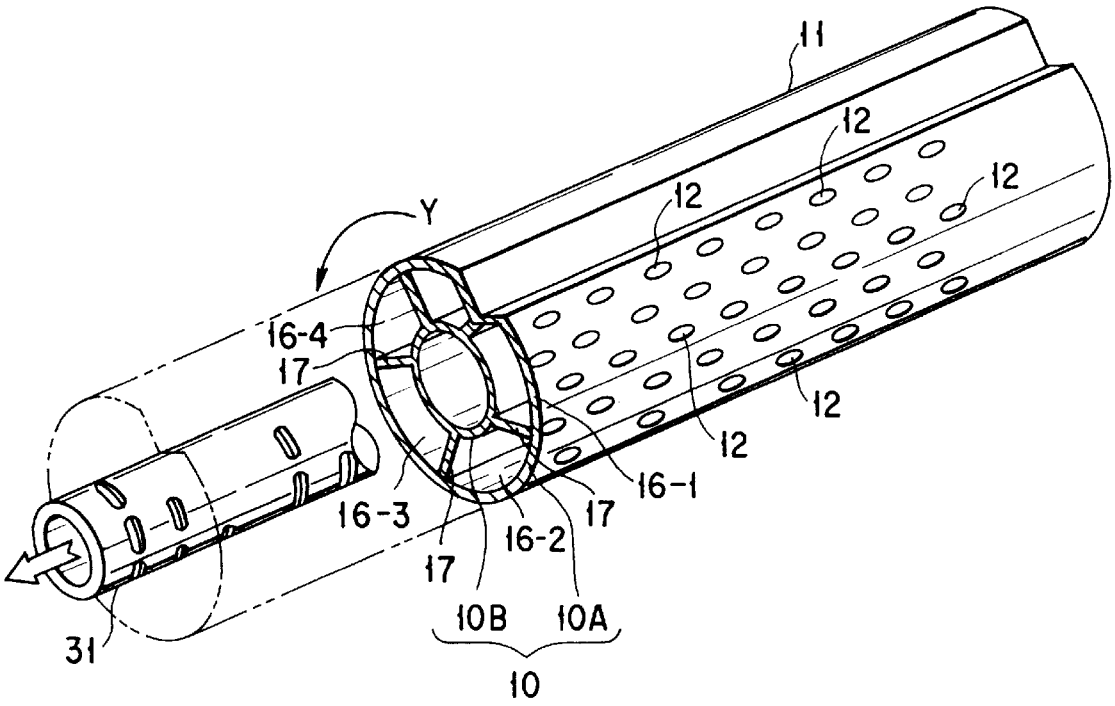
FIG. 9 is a view showing the internal structure of a rotary drum to be adopted to the sheet holding system shown in FIG. 7.
Figure 10:
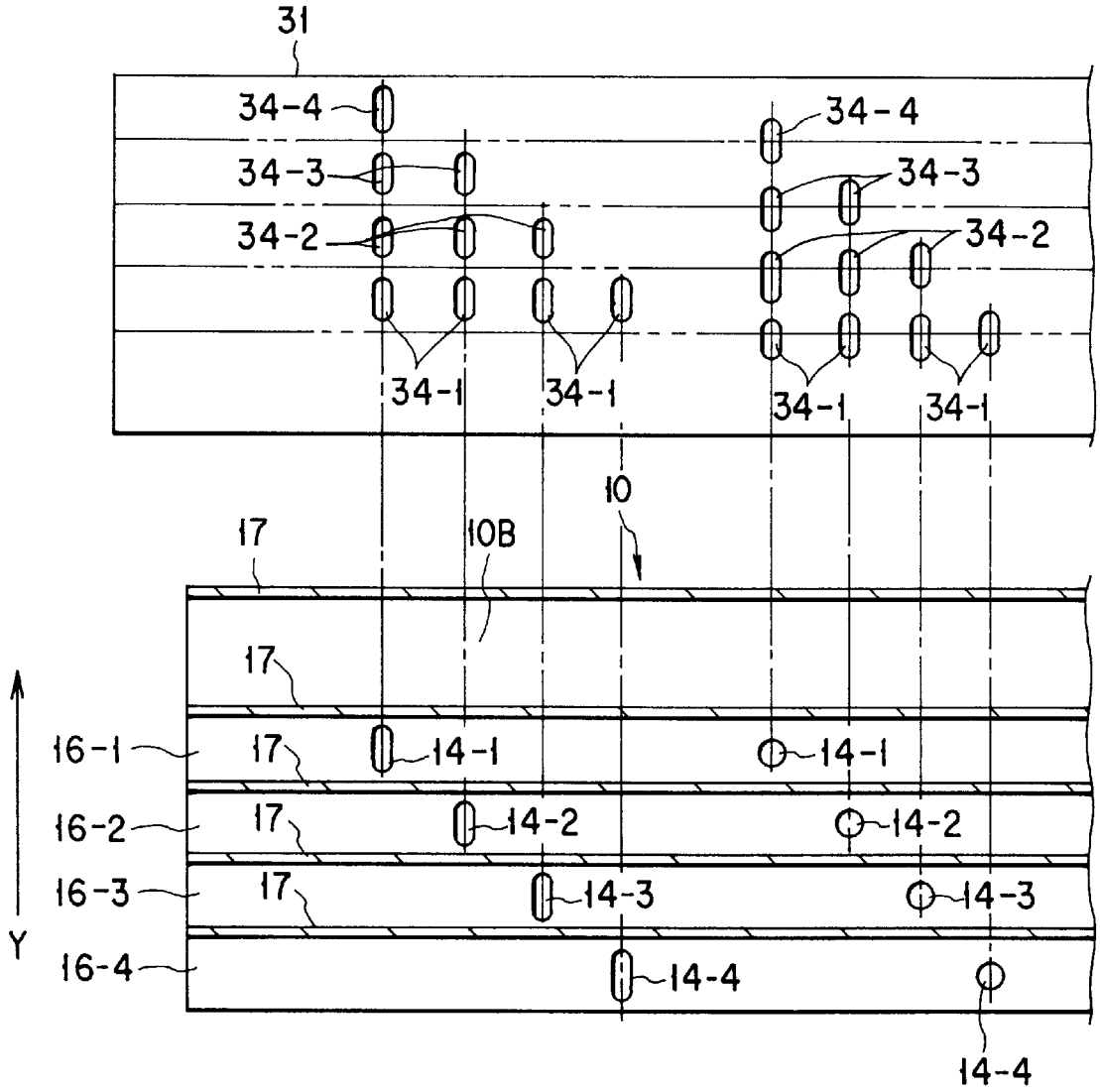
FIG. 10 is a developed view for explaining the positional relationship between air holes of the drum and air holes of a small diameter hollow tube shown in FIG. 9.

As shown in FIGS. 9 and 10, the partition wall 17 extends in the radial direction of the rotary drum 10 and partitions the space 16 between the outer cylindrical member 10A and the inner cylindrical member 10B into five air rooms. The four successive air rooms excluding one air room are used as negative pressure creating rooms 16-1, 16-2, 16-3, 16-4. The suction holes 12 are formed in the outer cylindrical member 10A of the rotary drum 10 according to the length of the paper sheet M so that the space of the negative pressure creating rooms 16-1 to 16-4 can communicate with the outside space. The suction holes 12 are formed to have a span set within a range not exceeding the smallest width of the paper sheet M to be used. The plurality of the suction and blow air holes 14-1 to 14-4 are formed in the inner cylindrical member 10B of the rotary drum 10 so that the space of the negative pressure creating rooms 16-1 to 16-4 can communicate with the outside space. The suction and blow air holes 14-1 to 14-4 are elongated or round holes. The suction and blow air holes (for example, suction and blow air holes 14-1, 14-1) formed for the same negative pressure creating room have the same phase in the axial direction of the rotary drum 10. The small diameter hollow tube 31 has suction and blow air holes 34-1, 34-2, 34-3, 34-4 formed to face the suction and blow air holes 14-1 to 14-4.

The suction and blow air holes 34-1 to 34-4 have the phase displacement to each other in the rotational direction of the rotary drum 10, and the end portions of the corresponding suction and blow air holes on the left side and the right side in FIG. 10 (for example, the corresponding suction and blow air holes 34-4, 34-4) can be overlapped in the axial direction of the rotary drum 10. Accordingly, the air in the negative pressure creating rooms 16-1 to 16-4 can be discharged to the outside continuously and smoothly via the suction and blow air holes 14-1 to 14-4 and the suction and blow air holes 34-1 to 34-4 (or air can be supplied from the outside continuously and smoothly).

The air-flow control mechanism has a stopper 101 as shown in FIG. 9. The stopper 101 opens the suction and blow air holes 14-1 to 14-4 of the rotary drum 10 by sequentially aligning the same with the suction and blow air holes 34-1 to 34-4 from the downstream side to the upstream side in the drum rotational direction (Y direction) using a difference obtained relatively between the rotational speeds of the small diameter hollow tube 31 and the rotary drum 10, and closes the same by releasing the alignment.

As explained in the above-mentioned embodiment, in the ink-jet printer, a positioning unit is provided as shown in FIGS. 6A to 6C to regulate the position of the front end of the paper sheet M on the drum peripheral surface 11. The positioning unit is formed of a positioning member 42 mounted rotatably around a pivot 42P in a dent portion 15 on the peripheral surface 11, a driver (not shown) for rotating the positioning member 42 in the open direction (J direction) and the close direction (opposite direction with respect to the J direction), for example.

Figure 8:
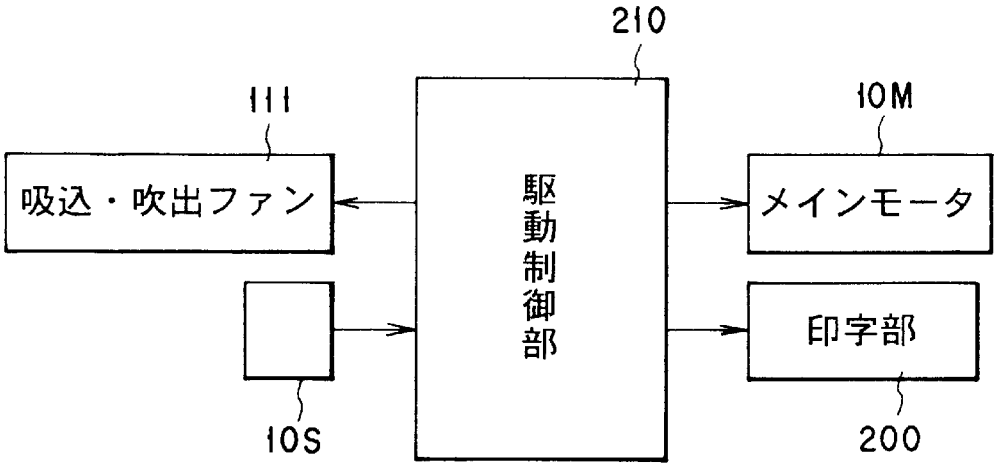
FIG. 8 is a block diagram for explaining a control unit which controls the sheet holding system shown in FIG. 7.

The control unit 210 shown in FIG. 8 includes a CPU, a ROM, a RAM, and the like and is capable of performing the entire drive control of the printer. Components not directly related with this device are not illustrated.

The operation of the ink-jet printer will be described below.

When the control unit 210 enables the stopper 101 in response to the paper sheet M fed to the sheet loading position for the rotary drum 10 which rotates in an air-suctioned state set by rotation of the suction and blow fan 111, the small diameter hollow tube 31 stops the rotation to sequentially align the suction and blow air holes 14-1 to 14-4 of the rotary drum 10 with the suction and blow air holes 34-1 to 34-4 of the small diameter hollow tube 31 from the downstream side to the upstream side in the rotational direction (Y direction), thereby opening the suction and blow air holes 14-1 to 14-4. That is, the suction and blow air holes 14-1 to 14-4 are sequentially opened in the order opposite to the drum rotational direction.

When the down stream side suction and blow air hole 14-1 is opened, air in the corresponding negative pressure creating room 16-1 is suctioned to the outside through the suction and blow air hole 14-1 to create the negative pressure in the negative pressure creating room 16-1. Therefore, the front end of the paper sheet M reached at a position facing to the suction hole 12 of the negative pressure creating room 16-1 is held by the negative pressure suction applied via the suction hole 12. Since the front end of the paper sheet M is regulated by the positioning member 42, the holding position is accurate.

The rear part of the paper sheet M with respect to the front end is held on the drum peripheral surface 11 by suction using the negative pressure sequentially created in the negative pressure creating rooms 16-2, 16-3, 16-4 of the upstream side in the rotational direction and applied via the opposing suction holes 12.

In addition, the paper sheet M is selectable from kinds of paper sheets having different length (for example, A4, A5 sheets, and the like). Since the negative pressure creating rooms 16-1 to 16-4 and the suction holes 12 are formed according to the length of the paper sheets M, any selected kind of the paper sheet M can be securely held by suction.

Since the negative pressure is created in each of the negative pressure creating rooms 16-1 to 16-4 in a state where the corresponding suction holes 12 are covered by the paper sheet M1, a foreign substance (for example, an ink in the print head 200) is not suctioned via the suction hole 12, and thus contamination of the drum peripheral surface 11, and the like can be prevented.

Printing is performed by jetting ink from the print head 200 to the paper sheet M which is held on the drum peripheral surface 11 as described above. At the time, the small diameter hollow tube 31 is rotated at the speed the same as the rotary drum 10 to maintain a state where all the suction air holes 34-1 to 34-4 are aligned with the suction air holes 14-1 to 14-4 respectively. Therefore, printing can be performed on the paper sheet M securely held on the drum peripheral surface 11.

After printing, the stopper 101 is driven and the rotating state of the suction and blow fan 111 is changed into an air-blow state. At this time, the suction and blow air holes 14-1 to 14-4 of the rotary drum 10 in motion are sequentially aligned with the corresponding suction and blow air holes 34-1 to 34-4 from the downstream side to the upstream side in the drum rotational direction (Y direction) since the suction and blow air holes rotate one revolution relatively to the corresponding suction and blow air holes.

Therefore, air is flown into the negative pressure creating rooms 16-1 to 16-4 via the suction and blow air holes 14-1 to 14-4 and suction and blow air holes 34-1 to 34-4 aligned with each other, and the negative pressure in each of the negative pressure creating rooms 16-1 to 16-4 is sequentially lost in the order opposite to the drum rotational direction (Y direction).

Besides, the air supplied into the negative pressure creating rooms 16-1 to 16-4 is blown out from each suction hole 12 toward the paper sheet M. Therefore, the paper sheet M can be released from the drum peripheral surface 11 rapidly and securely.

According to this embodiment, since the negative pressure creating rooms 16-1 to 16-4, the suction hole 12 and the suction and blow air holes 14-1 to 14-4 are provided on the rotary drum 10 side, the corresponding suction and blow air holes 34-1 to 34-4, the stopper 101 and the suction and blow fan 111 are provided on the small diameter hollow tube 31 side, and the suction and blow air holes 14-1 to 14-4 are opened from the downstream side to the upstream side in the rotational direction (Y) of the rotary drum 10 so as to sequentially create the negative pressure in the negative pressure creating rooms 16-1 to 16-4 in the order opposite to the rotational direction (Y), the paper sheet M can be held on the drum peripheral surface 11 by negative pressure suction rapidly and securely.

Further, since the rotation state of the suction and blow fan 111 is changed into an air-blow state, air can be blown toward the paper sheet M from each suction hole 12. Therefore, the paper sheet M can be released from the drum peripheral surface 11 after printing quickly and securely.

Since positioning of the front end of the paper sheet M held on the drum peripheral surface 11 is performed by the positioning member 42, the accuracy of the holding position of the paper sheet M can be further improved.

We claim:

1. An ink-jet printer comprising:

a rotary drum having a peripheral surface with a plurality of suction holes arranged therein and rotating at a constant speed;

a medium loading section for loading a printing medium to the peripheral surface of said rotary drum;

a medium holding system for holding the printing medium on the peripheral surface of said rotary drum by applying negative suction pressure to the printing medium via the suction holes; and a print head for printing an image by jetting ink onto the printing medium held on the peripheral surface of said rotary drum;

wherein said rotary drum has an outer cylindrical member serving as the peripheral surface, an inner cylindrical member having a diameter smaller than said outer cylindrical member, and a partitioning wall section for fixing said inner cylindrical member within said outer cylindrical member at a uniform distance from said outer cylindrical member and for partitioning a space between said inner cylindrical member and said outer cylindrical member into a plurality of air rooms in a drum rotational direction, said medium holding system including a plurality of air holes arranged in said inner cylindrical member to associate with said air rooms, a suction unit for suctioning air via said air holes to set said air rooms in a negative pressure state, and an air-flow control mechanism for sequentially setting said air holes from a closed state to an open state as corresponding suction holes pass a loading position of the printing medium by rotation of said rotary drum.

2. The ink-jet printer according to claim 1, wherein said air-flow control mechanism includes a hollow tube inserted into said inner cylindrical member and rotatable together with said rotary drum and having a plurality of air holes which are formed to associate with said air holes of said inner cylindrical member, and a hollow tube controller for opening the air holes of said inner cylindrical member by selectively aligning the air holes of said hollow tube with the air holes of said inner cylindrical member using a difference between relative rotation speeds of said rotary drum and said hollow tube, and closing the air holes of said inner cylindrical member by releasing the selective alignment.

3. The ink-jet printer according to claim 2, wherein said air-flow control mechanism includes a plurality of ventilation holes arranged in said inner cylindrical member with a displacement in an axial direction of said rotary drum from said air holes of said cylindrical member to associate with said air rooms, a plurality of ventilation holes formed in said hollow tube to associate with the ventilation holes of said inner cylindrical member, and a ventilator for ventilating said hollow tube after printing and for causing said hollow tube to be moved in the axial direction of said rotary drum, the ventilation holes of said hollow tube being sequentially aligned with the ventilation holes of said inner cylindrical member associated with the corresponding suction holes which pass a removing position for the printing medium as said rotary drum rotates.

4. The ink-jet printer according to claim 1, wherein said medium holding system further includes a positioner for regulating a front end of the printing medium held on the peripheral surface of said rotary drum.

5. The ink-jet printer according to claim 1, wherein said suction unit blows air into said air rooms via the air holes of said inner cylindrical member after printing, and said air-flow control mechanism sequentially sets the air holes from the closed state to the open state as said corresponding suction holes pass a removing position of the printing medium by the rotation of the rotary drum after printing.

6. The ink-jet printer according to claim 5, wherein said suction unit includes a fan for suctioning and blowing air via the air holes of said inner cylindrical member.

* * * * *